United States Patent [19]

Schley

[11] Patent Number: 4,977,622

[45] Date of Patent: Dec. 18, 1990

[54] MEDICAL GARMENT

[76] Inventor: Marlene J. Schley, 9203 West Wisconsin Ave., Milwaukee, Wis. 53226

[21] Appl. No.: 385,216

[22] Filed: Jul. 25, 1989

[51] Int. Cl.[5] ..... A41D 13/00; A41D 27/10

[52] U.S. Cl. ..... 2/59; 2/16; 2/125; 2/126; 2/114; 2/DIG. 7

[58] Field of Search ..... 2/16, 59, 91, 115, 126, 2/114, 125, DIG. 7

[56] References Cited

U.S. PATENT DOCUMENTS

| | | | |
|---|---|---|---|
| D. 299,562 | 1/1989 | Lee | 2/16 X |
| 676,158 | 6/1901 | St. John | 2/114 |
| 731,791 | 6/1903 | Krifka | 2/16 |
| 807,628 | 12/1905 | Marks | 2/59 |
| 1,157,341 | 10/1915 | Tollerday | 2/91 |
| 1,227,052 | 5/1917 | Hogan | 2/59 |
| 1,250,836 | 12/1917 | Fowler | 2/91 |
| 1,266,506 | 5/1918 | Louder | 2/59 |
| 1,285,917 | 11/1918 | Bradley | 2/91 |
| 1,577,630 | 3/1926 | Yerger | 2/59 |
| 2,045,157 | 6/1936 | Mathias | 2/59 X |
| 2,150,069 | 3/1939 | Kolena | 2/59 |
| 2,153,838 | 4/1939 | Jay | 2/125 |
| 2,904,792 | 9/1959 | Elliott | 2/59 X |
| 3,329,144 | 7/1967 | Liman | 2/59 X |
| 3,657,741 | 4/1972 | Blanco | 2/59 |
| 3,837,007 | 9/1974 | Girest | 2/126 X |
| 4,036,220 | 7/1977 | Bellasalma | 2/59 X |
| 4,569,087 | 2/1986 | Kerwin | 2/126 |
| 4,570,267 | 2/1986 | Appell | 2/91 |
| 4,706,304 | 11/1987 | Jones | 2/91 |

FOREIGN PATENT DOCUMENTS

| | | | |
|---|---|---|---|
| 287546 | 5/1928 | United Kingdom | 2/59 |
| 2027330 | 2/1980 | United Kingdom | 2/115 |

*Primary Examiner*—Werner H. Schroeder
*Assistant Examiner*—Jeanette E. Chapman
*Attorney, Agent, or Firm*—Godfrey & Kahn

[57] ABSTRACT

A medical garment for covering a patient's arms and shoulders. The medical garment includes first and second sleeves which are adapted to enclose the arms and shoulders of the patient and which are releasably joined together by respective elongated straps, and one of the sleeves is operable to open thereby allowing therapeutic or diagnostic procedures to take place without requiring removal of the medical garment.

17 Claims, 2 Drawing Sheets

MEDICAL GARMENT

BACKGROUND OF THE INVENTION

1. Field of the Invention

The present invention generally relates to a medical garment for protecting a patient's shoulders and arms, and more particularly to such a medical garment which readily permits access to one of the patient's arms while the patient is wearing the garment.

2. Description of the Prior Art

The debilitating effects of prolonged hospitalization wherein a patient may be bedridden for substantial periods of time has long been known. Such effects can take many forms, however, one of the most common symptoms of long-term hospitalization appears as cardiovascular circulatory problems in the extremities. These circulatory problems frequently manifest themselves by the patient feeling cold. While this symptom can be easily treated by readjusting the patients body to ensure better circulation or by treatment of the anomaly which is causing the circulatory problem with medicinal or chemical treatments either to effect dilation of the blood vessels or a chemically induced erosion, or to induce the breaking up and dissolution of the material obstructing the blood vessels, it has long been known that such chemotherapeutic practices have limited utility and are restricted to use in a rather insubstantial portion of the pathological environments. Most commonly, the symptom described above is treated by merely covering the extremity with a suitable blanket or other similar insulative device.

While the aforementioned practices have operated with varying degrees of success they individually possess shortcomings which have detracted from their usefulness. For example, the chemical or medicinal treatment of obstructions to the blood vessels although useful, may not be immediately possible because of the present medical treatment being provided for another anomaly or related disorder. Further, the medical treatment being provided may include intravenous therapy with assorted drugs or chemotherapy. Moreover, the patient may be intubated, as through the chest cavity, and as a result the bedclothing is partially removed to expose the intubation site, and as a consequence the arms of the patient are exposed either because of convenience or because of necessity such that other intravenous tubes may enter the patient's arm, or for purposes of positioning a blood pressure cuff for periodic monitoring of the patient's blood pressure. Under these circumstances, the practice of using a blanket or other similar insulative device is not practical and therefore patients may be uncomfortably cold for prolonged periods of time.

Therefore, it has long been known that it would be desirable to have a medical garment which is particularly well suited to shielding and insulating the arms of a patient and which would simultaneously permit therapeutic procedures to be performed without requiring removal of the garment, and which further can be manufactured in a single size and which can be readily adjusted such that it can be comfortably worn by patients having assorted body sizes.

OBJECTS AND SUMMARY OF THE INVENTION

It is therefore an object of the present invention to provide an improved medical garment for protecting the arms and shoulders of a patient who is undergoing medical treatment.

Another object of the present invention is to provide a medical garment which is readily adjustable such that it can be worn comfortably by patients having assorted body sizes, and which further permits access to the inside portion of one of the patient's arms for purposes of medical treatment or the like.

Another object of the present invention is to provide a medical garment which is adapted to improve circulation in the arms of a patient undergoing medical treatment.

Another object of the present invention is to provide a medical garment which can be employed with minimal risk of contamination or interference, during the use thereof, in assorted medical procedures.

Another object of the present invention is to provide a medical garment wherein means are provided for permitting continuous and reliable ascertainment by medical personnel of intravenous tubes, when such intravenous tubes are inserted within the body tissue of a patient's arms while simultaneous shielding and insulating the same arm.

Another object of the present invention is to provide a medical garment having means for retaining said garment in a predetermined closed position.

Another object of the present invention is to provide a medical garment of such durable construction as virtually to preclude damage thereto, or deterioration thereof, during its lifetime.

Another object of the present invention is to provide a medical garment which is constructed of inexpensive materials thereby permitting the economical disposal of the same medical garment after the use thereof thereby preventing the possible transmission of disease from one patient to another.

Another object of the present invention is to provide a medical garment which is characterized by ease of employment, simplicity of construction, and which can be manufactured and sold at a nominal expense.

Another object of the present invention is to provide a medical garment which is operable to obtain the benefits derived from related prior art devices and practices while avoiding the detriments individually associated therewith.

Further objects and advantages are to provide improved elements and arrangements thereof in a medical garment for the purposes intended, which is dependable, durable and fully effective in accomplishing its intended purposes.

These and other objects and advantages are achieved in a medical garment for protecting a patient's shoulders and arms and possessing a first sleeve having a flexible main body which is adapted to cover one of the patient's arms and related shoulder, a second sleeve having a flexible, discontinuous main body which covers the patient's other arm and related shoulder and which includes an opening which permits access to the inside portion of the patient's other arm, means mounted on said respective sleeves for releasably joining the first and second sleeves together in predetermined spaced relation, and means mounted on said second sleeve for closing said opening thereby inhibiting access to the inside portion of the patient's other arm.

DESCRIPTION OF THE PREFERRED EMBODIMENT

Figure 1:
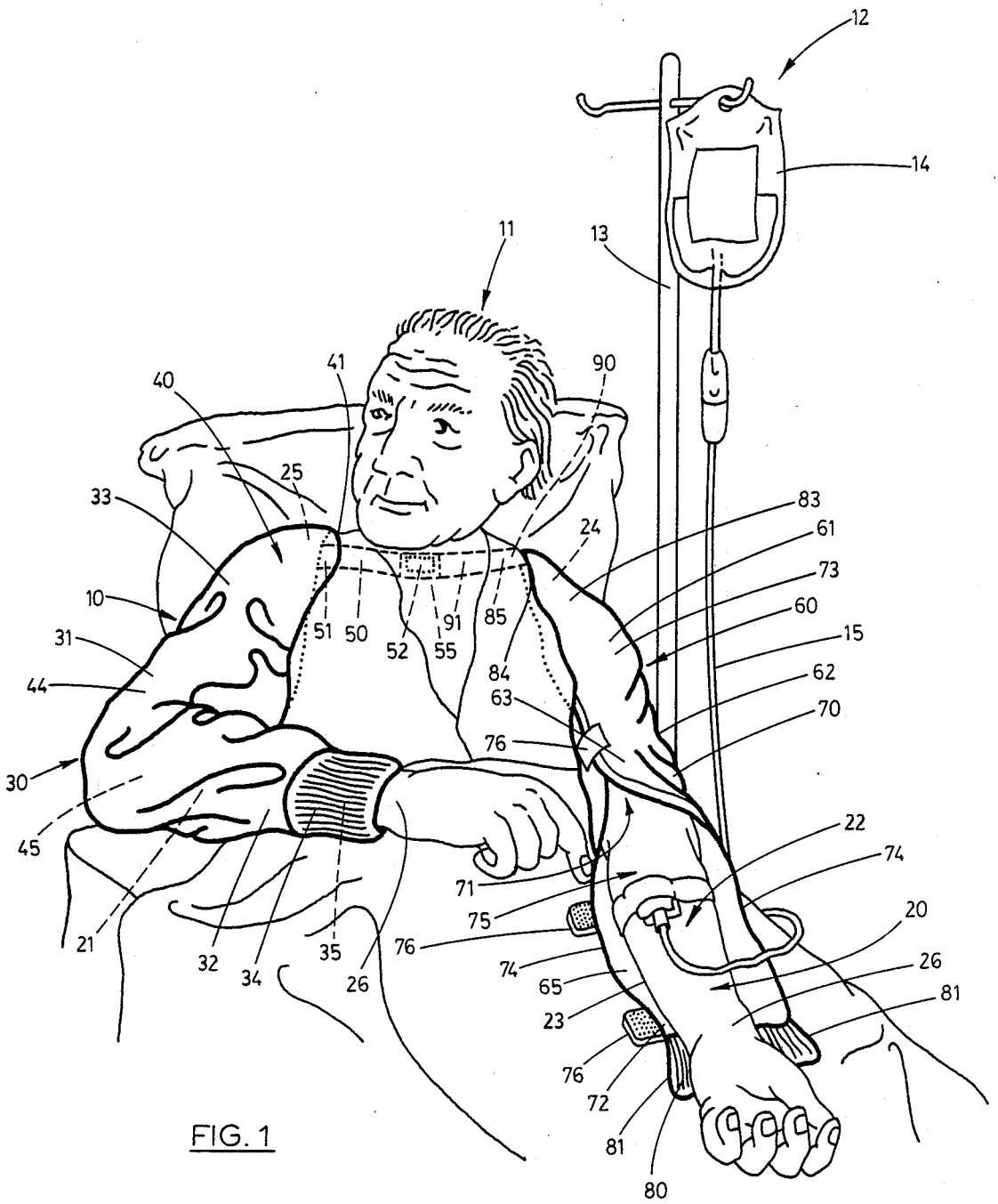
FIG. 1 is a perspective side elevational view of the medical garment embodying the principles of the present invention shown in a typical operative environment.
Figure 2:
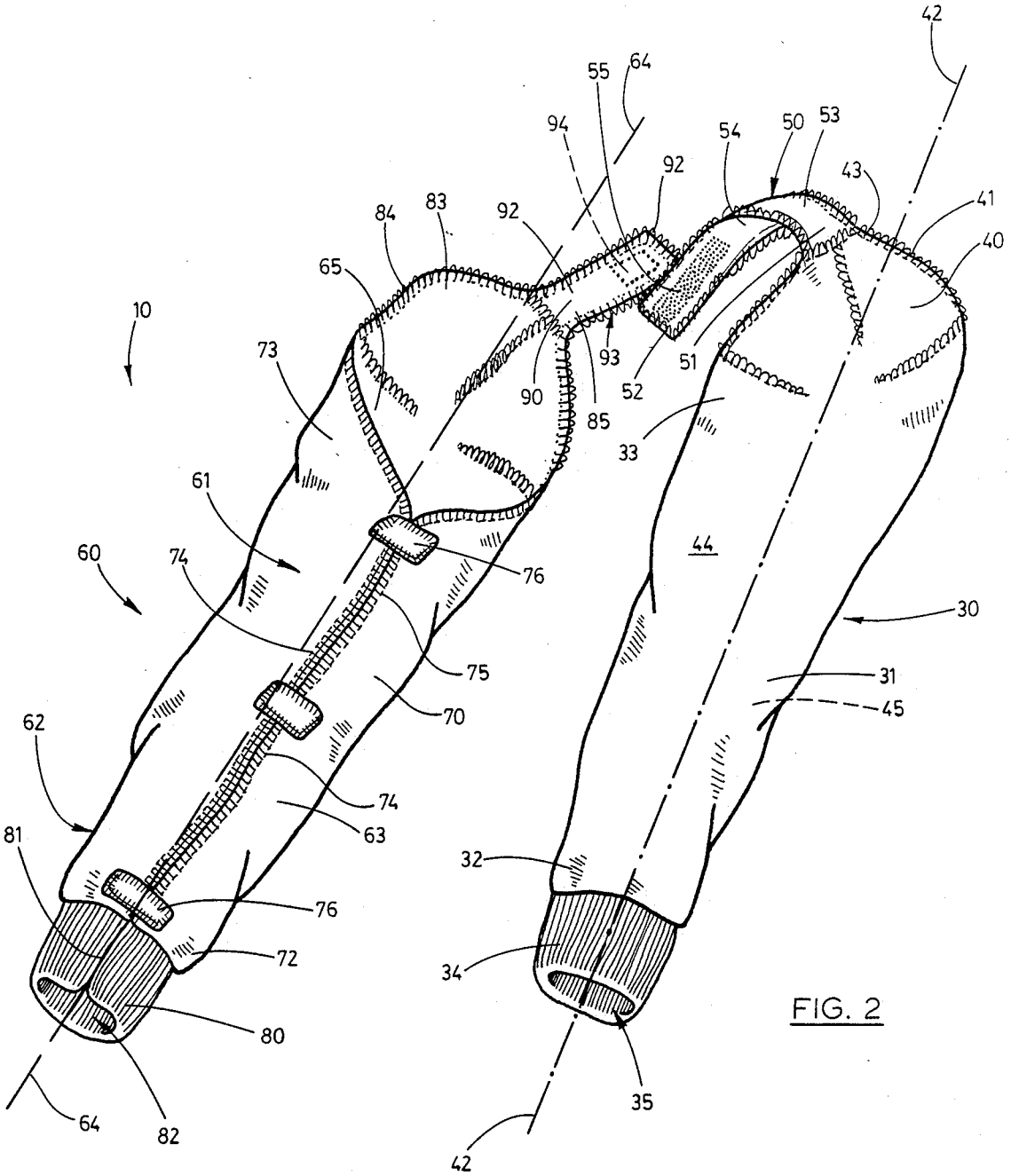
FIG. 2 is a second, side elevational view of the medical garment embodying the principles of the present invention.

Referring more particularly to the drawings, the medical garment embodying the principles of the present invention is designated generally by the numeral 10 in FIG. 1.

For illustrative convenience only, the medical garment 10, as shown and described herein, will be discussed as it would be configured if it were worn by a patient 11, which is undergoing intravenous medical treatment with intravenous equipment 12 which includes a support 13, a source of intravenous fluid 14, and a supply tube 15 which enters a suitable blood vessel in the patient's arm through an appropriate needle, not shown. As best seen by reference to FIG. 1 the patient's left and right arms, 20 and 21 respectively, are enclosed within the medical garment, the medical garment protectively covering the respective inside and outside portions 22 and 23 of each arm. Further the medical garment 10 is adapted to cover the patient's left and right shoulders, 24 and 25 as well as both wrists 26.

The medical garment 10 of the subject invention includes a first sleeve 30 which has a flexible main body 31 and which is manufactured from a suitable, comfortable cloth such as cotton, or from a disposable material such as paper or the like. The first sleeve has opposite first and second ends 32 and 33 respectively, and a unitary, resilient cuff 34 is integrally formed with the first end 32. The cuff 34 defines a passageway 35. The first sleeve 30 further includes a shoulder portion 40 which is positioned on the second end of the main body 31, and which is defined by an arcuately shaped peripheral edge 41. The first sleeve 30 includes a longitudinal line of reference 42, and the main body 31 has inside and outside surfaces 43 and 44 respectively. The first sleeve defines a passageway 45 which is disposed in registery with the passageway 35. An elongated strap 50 having opposite first and second ends 51 and 52 respectively, is mounted at its first end on the shoulder portion 40 of the first sleeve. The elongated strap, which extends longitudinally and outwardly relative to the peripheral edge, has opposite inwardly and outwardly facing surfaces 43 and 44, respectively. An adjustable fastener having opposite mating portions is adapted to be mounted on the inwardly facing surface of the second end. In the preferred embodiment the adjustable fastener includes an elongated piece of Velcro® tape 55 which is fastened, utilizing stitching or the like, to the flexible strap. However, it will be readily recognized that other fasteners such as a plurality of buttons or snaps can be substituted for same.

A second sleeve, which is generally indicated by the numeral 60, has a flexible, discontinuous main body 61. The main body 61 has an outside facing portion 62 and an opposite inside facing portion 63, the respective inside and outside facing portions are individually positioned in covering relation relative to the inside and outside portions 22 and 23 of the patient's left arm 20. The second sleeve includes a longitudinal line of reference which is indicated by the line labeled 64, and further has inside and outside surfaces 65 and 70, respectively. The main body 61 defines a passageway or channel 71 which is adapted to receive the patient's left arm. This is best illustrated by reference to FIG. 1. The flexible main body also includes opposite first and second ends 72 and 73 and further has a pair of longitudinally disposed edges 74 which define an elongated opening or gap 75 which permits access to the inside portion 22 of the patient's arm. A plurality of fasteners having opposite mating portions and herein illustrated as Velcro® tape 76 are individually mounted in predetermined substantially equally spaced relation on the inside facing portion of the second sleeve and along the longitudinally disposed edges. The individual Velcro® fasteners are operable to close the opening or gap 75 thereby inhibiting access to the inside portion of the patient's arm. In this fashion the second sleeve can be opened to allow access to the patient's arm for purposes of diagnosis or therapy, such as the insertion of an intravenous needle, not shown, but which can later be closed for purposes of making the patient more comfortable.

A resilient, discontinuous cuff 80 is fixed to or otherwise made integral with the first end 72, of the main body 61. The cuff includes a pair of longitudinally disposed edges 81, and defines a passageway 82 which is positioned in registry with the passageway 71 which is defined by the main body 61. The flexible main body 61 includes a shoulder portion 83 which is made integral with the second end 73 and which further is made integral with the outside facing portion 62 thereof. The shoulder portion 83 is operable to cover the patient's left shoulder 24 and further is defined by an arcuately shaped peripheral edge 84. An elongated, flexible strap 85 has a first end 90 and an opposite, second end 91 which extends longitudinally and outwardly relative to the peripheral edge. The first end 90 is fixed to the peripheral edge 84 by stitching or by some other suitable fastening technique. The elongated strap 85 has opposite, inwardly and outwardly facing surfaces 92 and 93, respectively, and a mating piece of Velcro® tape 94 is fixed on the outwardly facing surface 93 on the second end. The Velcro®tape is adapted to adjustably mate with the Velcro® tape 55 which is fixed on the elongated strap 50.

OPERATION

The operation of the described embodiment of the present invention is believed to be readily apparent and is briefly summarized at this point.

The medical garment 10 of the present invention includes first and second sleeves 30 and 60, respectively, which are adapted to individually receive the patient's arms 20 and 21. The individual sleeves are releasably connected together by means of a pair of elongated straps 50 and 85, respectively, which are joined together by mating portions of Velcro® tape 55 and 94 which are individually fixed on the second ends 52 and 91 of each of the straps. When utilized, the medical garment 10 covers the arms and shoulders of the patient and is held in place by the elongated straps which are adjusted, as to length, and fastened together so that they fit snugly and securely across the shoulders of the patient. This is best seen by reference to FIG. 1. The individual pieces of Velcro® tape 55 and 94, which are fixed on the individual elongated straps, each have an elongated shape which permits the individual straps to be adjusted as to length. In this fashion the garment can be worn by individuals having different body sizes. As earlier discussed, the Velcro ® fasteners 76 individually allow access to the inside portion 22 of one of the patient's arms thereby allowing therapy to take place without requiring removal of the medical garment.

Thus the medical garment 10 of the subject invention provides a means by which a patient can be kept comfortable while undergoing therapy which would have, heretofore, exposed the arms of the patient for prolonged periods of time, and which further is easy to wear, does not substantially interfere with any ongoing therapy, and which can be manufactured and sold at a relatively nominal price.

Although the invention has been herein shown and described in what is conceived to be the most practical and preferred embodiment, it is recognized that departures may be made therefrom, within the scope of the invention, which is not to be limited to the illustrative details disclosed.

Having described my invention, what I claim as new and desire to secure by LETTERS PATENT is:

1. A medical garment for shielding and insulating the arms and shoulders of a person and operable to permit selective access to one of the arms of the person thereby permitting ongoing medical treatment without requiring removal of the medical garment comprising:

a first sleeve having a continuous and flexible main body which is adapted to shield and insulate one of the patient's arms and associated shoulder;

a second sleeve having a flexible, discontinuous main body which shields and insulates the patient's other arm and associated shoulder and which is adapted to be selectively opened and closed thereby permitting access to the inside portion of the patient's other arm and thus allowing medical treatment at a predetermined site;

means mounted on said respective sleeves for releasably joining said first and second sleeves together in predetermined spaced relation; and means mounted on said second sleeve for releasably closing the second sleeve thereby inhibiting access to the inside portion of the patient's other arm but permitting limited access to the site of the medical treatment.

2. A medical garment as claimed in claim 1 and wherein said main body of said first sleeve has opposite first and second ends, and a resilient cuff is fixed on said first end and is operable to enclose the wrist of said patient's arm, and a shoulder portion is integral with said second end and is adapted to shield and insulate the associated shoulder of the patient.

3. A medical garment as claimed in claim 2 and wherein the patient's other arm has an inside and an outside portion and said main body of said second sleeve has opposite first and second ends, a longitudinal line of reference, and inside and outside portions which are operable to respectively cover the inside and outside portions of said other arm, said inside portion of said main body having a pair of longitudinally disposed edges which define an opening which permits access to the inside portion of said arm, and a shoulder portion to shield and insulate said shoulder is located at the second end and is integral with the outside portion of said main body.

4. A medical garment as claimed in claim 3 and wherein a resilient discontinuous cuff is fixed on said first end of said second sleeve and is operable to enclose the wrist of said patient's other arm; and wherein said respective shoulder portions of each sleeve have a peripheral edge; and wherein said means for releasably joining said first and second sleeves together includes a pair of flexible, elongated straps which individually have a first end which is fixed to the peripheral edge of the respective shoulder portions, said elongated straps each having a second end which extends outwardly and longitudinally relative to the respective sleeves; and wherein an adjustable fastener having opposite mating portions is respectively mounted on the second end of each strap and is operable to releasably join the individual straps together.

5. A medical garment as claimed in claim 4 and wherein said longitudinally disposed edges extend from the first to the second ends of the sleeve.

6. A medical garment as claimed in claim 5 and wherein said releasable closing means includes at least one fastener having opposite mating portions which are respectively mounted on the individual longitudinally disposed edges.

7. A medical garment as claimed in claim 5 and wherein said first and second sleeves are manufactured from cloth.

8. A medical garment as claimed in claim 6 and wherein said first and second sleeves are manufactured from disposable materials.

9. A medical garment as claimed in claim 6 and wherein said fasteners are Velcro ® tape.

10. A medical garment for shielding and insulating a patient's arms and shoulders and operable to permit selective access to the inside portion of one of the patient's arms for purposes of rendering medical treatment at a predetermined site, and wherein said medical garment can be employed during the medical treatment with minimal risk of contamination or interference while simultaneously shielding and insulating the patient's arm, the medical garment comprising:

a first sleeve including an elongated, unitary, flexible main body with opposite first and second ends, and which is adapted to enclose one of the patient's arms, a unitary continuous cuff fixed on said first end and adapted to enclose the wrist of the patient, a shoulder portion integral with said second end and adapted to shield and insulate a portion of the patient's shoulder, and a flexible strap fixed on the shoulder portion and having an elongated main body with an outer end;

a second sleeve including an elongated, discontinuous, flexible main body with opposite first and second ends, and a longitudinal line of reference, said second sleeve enclosing the patient's other arm, and which has a portion which covers the inside portion of said other arm, said portion having a pair of longitudinally disposed edges defining a longitudinally disposed opening which is positioned substantially along the inside portion of said arm, a discontinuous cuff fixed on said first end and adapted to enclose the wrist of the patient's other arm, a shoulder portion integral with the outside portion of the second end, and a flexible strap fixed to said shoulder portion and having an elongated main body with an outer end;

means mounted on said outer ends of each flexible strap for fastening said flexible straps together and thereby releasably joining said first and second sleeves together in predetermined spaced relation; and means mounted on the inside portion of said second sleeve for releasably closing the opening defined by said respective longitudinally disposed edges thereby inhibiting access to the inside portion of the patient's arm but permitting limited access to the site of the medical treatment.

11. A medical garment as set forth in claim 10 and wherein said pair of longitudinally disposed edges extend from the first to the second ends of the second sleeve, and wherein said fastener means include a fastener having opposite mating portions which are respectively mounted on the outer end of each of the respective straps, said fastener operable to adjust said straps as to length.

12. A medical garment as set forth in claim 11 and wherein a plurality of fasteners having opposite mating portions are respectively mounted in substantially equally spaced relation along the individual longitudinally disposed edges.

13. A medical garment as set forth in claim 12 and wherein said first and second sleeves are manufactured from cloth.

14. A medical garment as set forth in claim 12 and wherein said first and second sleeves are manufactured from a disposable material.

15. A medical garment as set forth in claim 12 and wherein said fasteners are adjustable thereby allowing the opening to have a predetermined dimension.

16. A medical garment a set forth in claim 12 and wherein said fasteners are Velcro® tape.

17. A medical garment for shielding and insulating a person's arms and shoulders and which permits selective access to one of the arms of the person, the medical garment comprising:

a first sleeve having a unitary, flexible, main body operable to completely enclose one of the arms of said person;

a second sleeve having a flexible and discontinuous main body which is operable to enclose the person's other arm and associated shoulder and which is operable to be selectively opened along its longitudinal dimension thereby facilitating access to said arm;

means mounted on said respective sleeves for releasably and adjustably joining said first and second sleeves together thereby providing a comfortable fit for a person of any body size; and means mounted on said second sleeve for releasably closing said opening.

* * * * *